US010166594B2

(12) United States Patent
Boschiero

(10) Patent No.: US 10,166,594 B2
(45) Date of Patent: Jan. 1, 2019

(54) SPRING FORMING DEVICE, METHOD FOR FORMING A HELICAL SPRING AND CORRESPONDING COMPUTER PROGRAM

(71) Applicant: Simplex Rapid S.R.L., San Giuliano Milanese (IT)

(72) Inventor: Paolo Boschiero, Milan (IT)

(73) Assignee: SIMPLEX RAPID S.R.L., San Giuliano Milanese (IT)

( * ) Notice: Subject to any disclaimer, the term of this patent is extended or adjusted under 35 U.S.C. 154(b) by 466 days.

(21) Appl. No.: 14/897,659

(22) PCT Filed: Apr. 24, 2014

(86) PCT No.: PCT/IB2014/060977
§ 371 (c)(1),
(2) Date: Dec. 11, 2015

(87) PCT Pub. No.: WO2015/008174
PCT Pub. Date: Jan. 22, 2015

(65) Prior Publication Data

US 2016/0107220 A1 Apr. 21, 2016

(30) Foreign Application Priority Data

Jul. 15, 2013 (IT) ..... MI2013A001181

(51) Int. Cl.
*B21F 3/02* (2006.01)
*B21F 35/00* (2006.01)

(52) U.S. Cl.
CPC ..... *B21F 3/02* (2013.01); *B21F 35/00* (2013.01)

(58) Field of Classification Search
CPC ..... B21F 3/02; B21F 35/00
See application file for complete search history.

(56) References Cited

U.S. PATENT DOCUMENTS 3,641,794 A 2/1972 Lidert
5,243,746 A 9/1993 Shinichi
(Continued)

FOREIGN PATENT DOCUMENTS

DE 10345445 A1 9/2004
DE 102006048642 A1 4/2008
(Continued)

OTHER PUBLICATIONS

International Search Report in PCT/IB2014/060977 dated Sep. 24, 2014.
(Continued)

*Primary Examiner* — Teresa M Ekiert
(74) *Attorney, Agent, or Firm* — Manelli Selter PLLC; Edward J. Stemberger

(57) ABSTRACT

The present invention refers to a spring forming device (1) comprising: a system (3) for feeding a wire (4) for forming a helical spring (2); a winding system (7) suitable for winding said wire (4) according to a helical configuration having a predefined diameter (D) extending along a helix development axis (A); one or more pitch tools (11, 13, 9), each suitable for acting on the wire (4) so that it takes on said cylindrical helix configuration with a predefined pitch (p); a system (15) for detecting the actual pitch of the spring forming in device (1) starting from said wire (4); means for detecting the amount (I) of the fed wire; a control unit configured for: —determining the actual length ($L_{eff}$) of the spring forming in the device starting from the actual amount of the fed wire (I) and actual pitch ($p_{eff}$) detected for portions of the spring, already formed in the device; —determining a reference length (L) as a function of said actual amount (I) of fed wire; —determining an error between said reference length (L) and said actual length ($L_{eff}$); —generating a command signal such to vary, during the spring formation,
(Continued)

the configuration of one of said one or more pitch tools (11, 13, 9) as a function of said error. Moreover, the present invention refers to a method for forming springs and a corresponding computer program.

15 Claims, 5 Drawing Sheets

(56) References Cited

U.S. PATENT DOCUMENTS

| | | | |
|---|---|---|---|
| 2011/0214467 | A1 | 9/2011 | Krueger et al. |
| 2011/0239718 | A1 | 10/2011 | Kalkau |

FOREIGN PATENT DOCUMENTS

| | | | |
|---|---|---|---|
| DE | 102010014385 | A1 | 10/2011 |
| JP | 2004314082 | A | 11/2004 |

OTHER PUBLICATIONS

Notice of Opposition in EP 3021996, English Translation thereof and supporting documents, dated Jan. 23, 2018.
Response to Notice of Opposition in EP 3021996 dated May 4, 2018.

SPRING FORMING DEVICE, METHOD FOR FORMING A HELICAL SPRING AND CORRESPONDING COMPUTER PROGRAM

FIELD OF THE INVENTION

The present invention refers to a spring forming device, particularly for forming helical springs for wire windings, usually of metal. Moreover, the present invention refers to a method for forming said springs. The device and method, according to the invention, are suitable for being applied to helical springs, such as for example cylindrical, conical, biconical, constant pitch or variable pitch springs.

PRIOR ART

The helical spring forming devices, known also as spring winding machines, have feeding rolls advancing an usually metal wire through a guide, until the latter arrives at winding tools provided with winding bits having wire guiding channels. The winding bits are arranged so that, as the wire is fed, these can deform the wire so that it takes a cylindrical shape with a diameter corresponding to the spring diameter, while a further tool provides for the generation of a determined pitch, by causing the spring to take an helical shape typical of the compression springs. When the so formed spring has reached the desired length or number of turns, a cutting tool cuts the wire which has not been already wound, so that the latter can be then worked with said modes for forming a further spring.

The springs must be formed with a predefined pitch, number of turns and length, falling in certain allowance limits.

The spring pitch is in relation with the pitch tool position. The pitch tool is kept in a fixed position for obtaining a constant pitch spring, while for obtaining a variable pitch spring, it is necessary to move the pitch tool according to a predefined law during the spring formation.

In case the actual pitch of the spring does not correspond to the desired pitch, the wire machining will produce a spring having a length different from the set length. Such error of the actual pitch of the spring can depend on different factors, such as for example: the lack of homogeneity of the physical and mechanical characteristics of the wire, the type and calibration of the device for unwinding the wire spool, variations of the pressure applied to the feeding rolls, mechanical clearances of the winding machine, vibrations of the spring during its formation.

In the known devices, possible errors of the actual pitch of the spring are detected a posteriori, only when the spring is completely or at least partially formed. Therefore, by examining a spring already formed, completely or partially, in the subsequent machining, the positioning of the pitch tools is modified in order to overcome the detected error in the previously formed spring or portion thereof. However, in this way, if the spring is measured after its formation and has been manufactured by wrong parameters, generally it must be discarded and the material forming it is therefore wasted, while if the spring is measured after its partial formation, the compensation necessary to cause the spring to fall into the correct parameters is discretely done and only in the remaining portion of the spring, so that it is formed a spring having two portions with different mechanical characteristics. The known devices performing a measurement of the partially formed spring moreover have limits when they are applied to springs having a high number of turns and they are hardly applicable to variable pitch springs.

A spring forming device according to the prior art is described in document US 2011/214467 A1.

SUMMARY OF THE INVENTION

Therefore, it is an object of the present invention to make available a device and method for forming springs, ensuring a high accuracy of the spring machining, particularly with reference to the pitch and length of the spring, and to reduce the rejected springs which do not fall inside the designated machining allowance limits.

This and other objects are obtained by a device for forming springs and a method for forming springs as claimed.

BRIEF DESCRIPTION OF THE FIGURES

In order to better understand the invention and appreciate its advantages, in the following some exemplifying non-limiting embodiments thereof will be described with reference to the attached figures, wherein.

DETAILED DESCRIPTION OF THE INVENTION

With reference to the attached figures, reference number 1 indicates a spring forming device.

Figure 1:
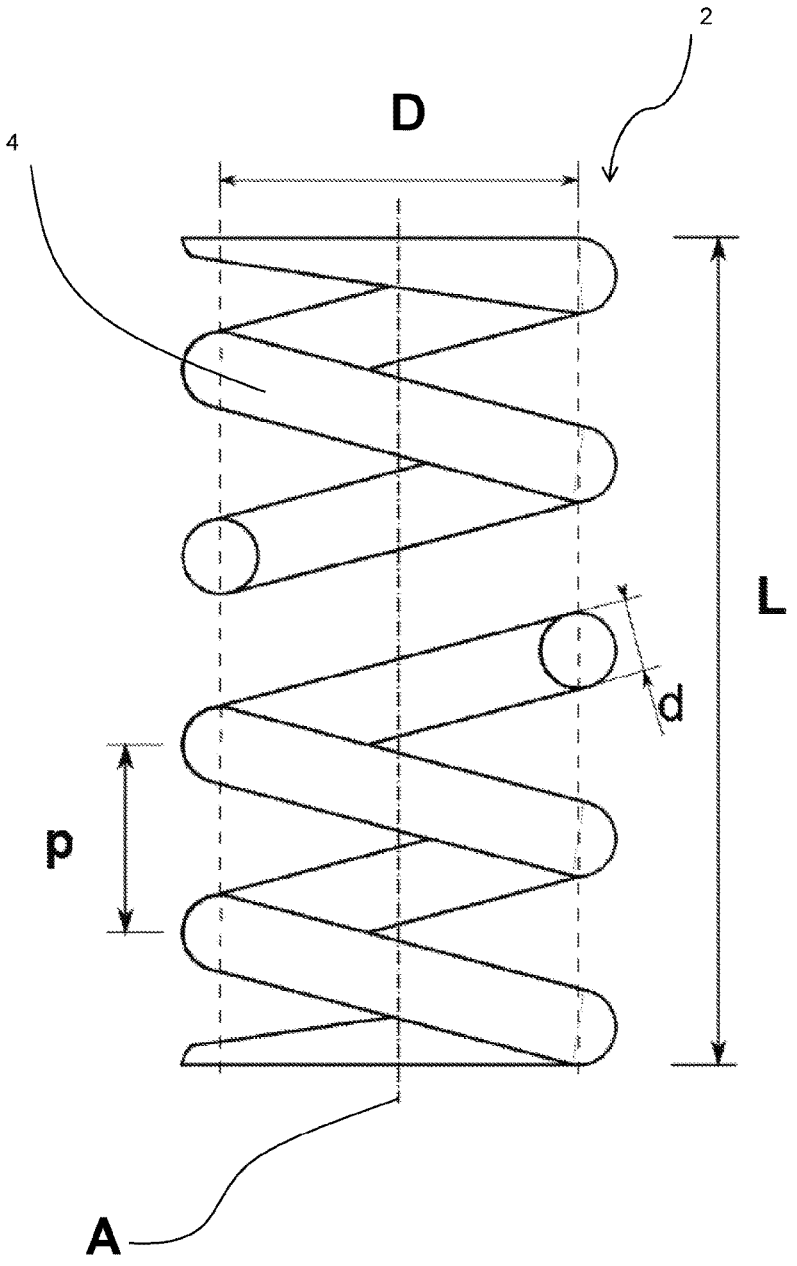
FIG. 1 is a partial cross-section side view of a spring with its characteristic parameters.

FIG. 1 schematically represents a helical spring 2 and its characteristic parameters are shown. Spring 2 is obtained by winding a wire 4, usually of metal, according to a helix (the longitudinal axis of the wire follows the helix trend). The spring has a diameter D coinciding with the diameter of a cylinder on which the wire axis is wound in case of a cylindrical helical spring. In this case, diameter D is constant. However, different geometries (for example a conical or biconical spring) are possible according to which such diameter D has a variable trend. Spring 2 has a pitch p, given by the distance between two successive turns, measured between two points of the longitudinal axis of the wire. The pitch p of the spring in FIG. 1 is constant, however it is possible to have also springs having a variable pitch.

Spring 2 is characterized by a number of turns n (called also active turns), cooperating in the spring formation, and by end turns.

Spring 2 has an overall length L, measured along a helix development longitudinal axis A, between the two end turns. Moreover, spring 2 has an overall length of wire I forming the spring.

The inclination of the turns with respect to a horizontal line is called winding angle $\alpha$.

In the following of the description and in the attached claims, reference will be made to the above mentioned terminology.

Figure 2:
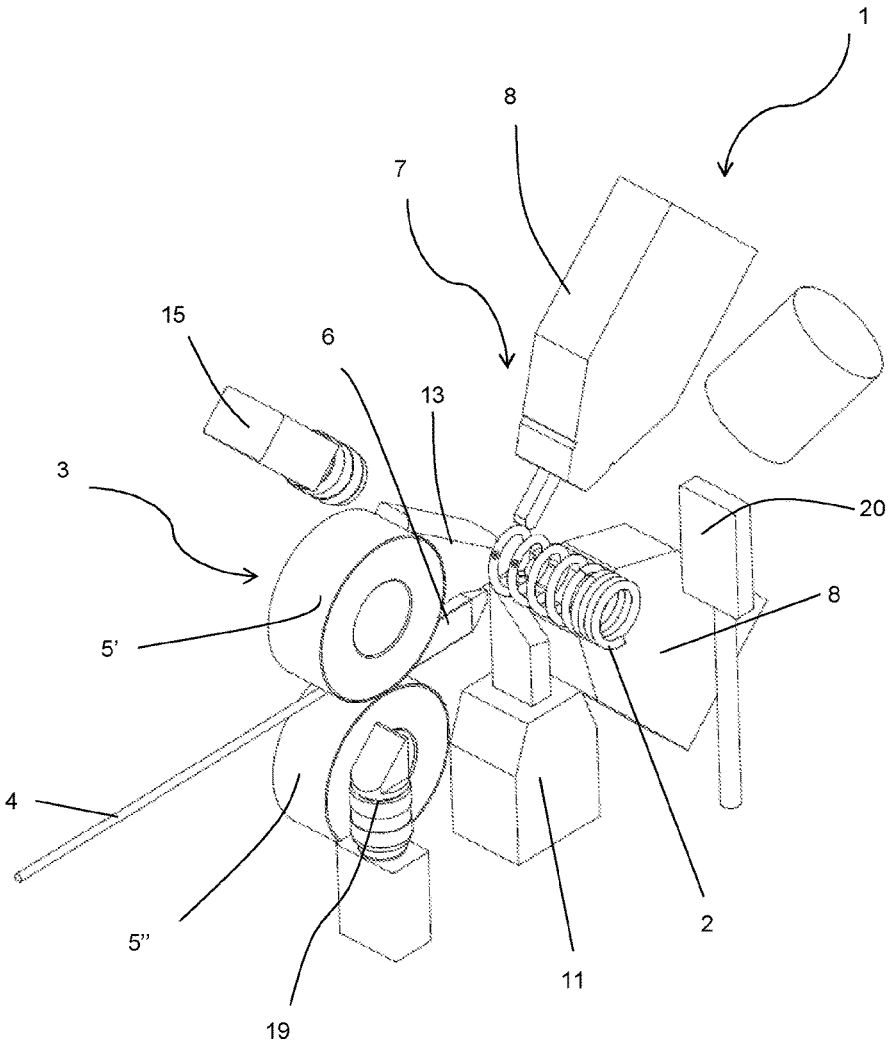
FIG. 2 is a perspective schematic view of a spring forming device according to an embodiment of the invention.
Figure 3:
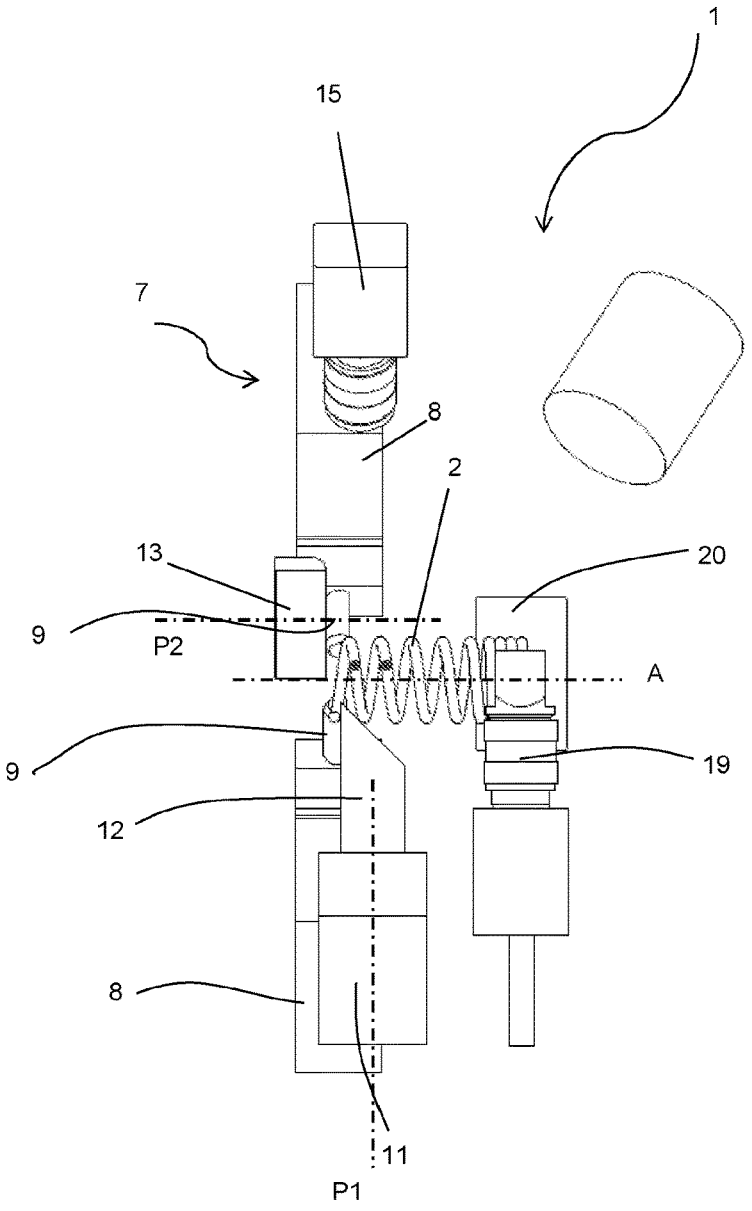
FIG. 3 is a side schematic view of the spring forming device in FIG. 2.
Figure 4:
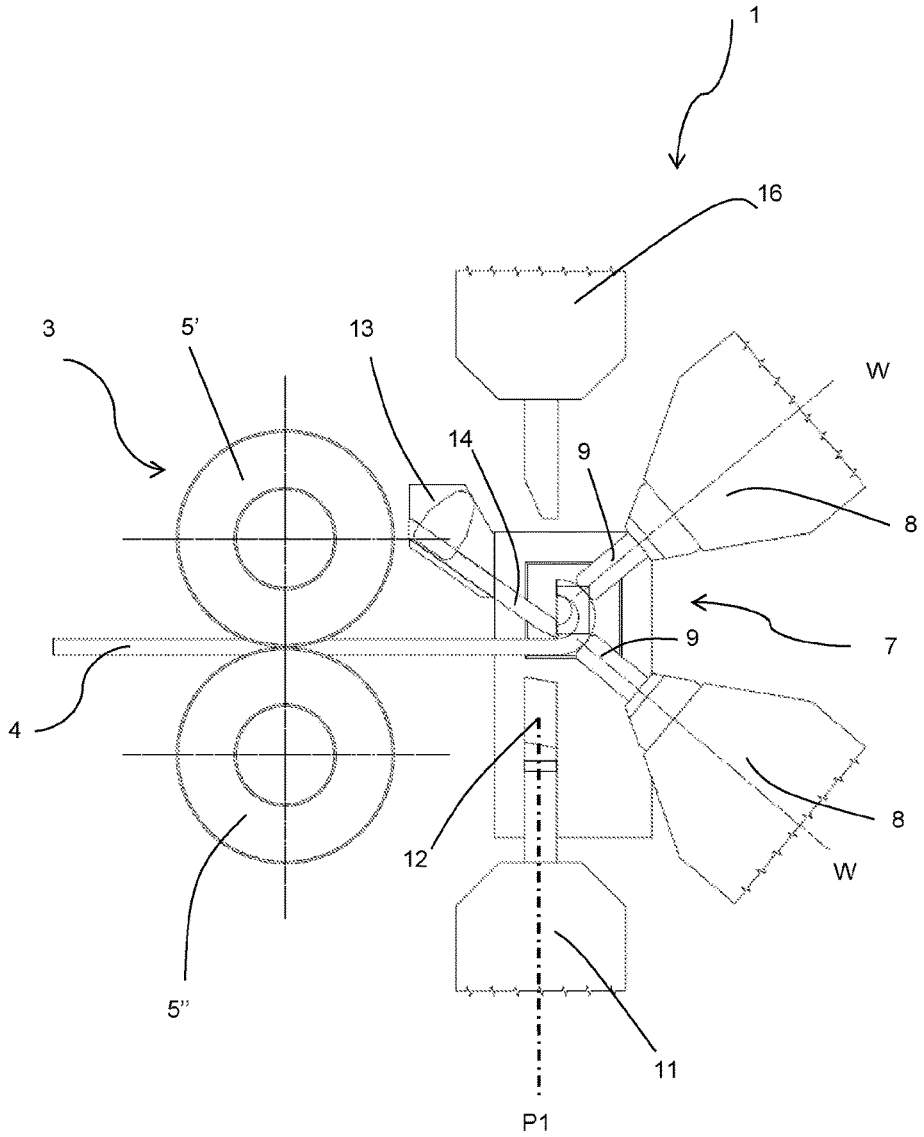
FIG. 4 is a front schematic view of a detail of the spring forming device in FIG. 1.

Referring again to device 1 (FIGS. 2-4), it comprises a system 3 for feeding the wire 4. Such wire 4, suitably deformed, will form the spring. Wire 4 is for example withdrawn by a loop, not shown in the figures. The wire feeding system 3 preferably comprises a first 5' and second rolls 5" opposite to each other, which pull the wire through a wire-guide 6. Alternatively, multiple pairs of opposite rolls can be provided for pulling the wire 4. The amount of fed wire, measurable by the wire length l, can be detected by suitable detecting means (not shown in figures). For example, it can be known by detecting the rotations of the opposite rolls pulling the wire itself.

Further, device 1 comprises a winding system 7 for winding wire 4 fed by the feeding system 3. Winding system 7 has the function of winding the wire 4 according to a helix shape extending along the helix development axis A having a predefined diameter D. With reference to the embodiment shown in FIGS. 2-4, the helix development axis A is normal to the plane where the fed wire lies. The predefined diameter D is selected in the step of setting the spring machining, and corresponds to the theoretical diameter which the spring must have. Such predefined diameter D can have a constant value (in this case a cylindrical spring is obtained) or it can have a variable value along the helix development axis A (in this case, a conical or biconical spring is obtained, for example).

Advantageously, the winding system 7 comprises one or more winding tools 8 having the function of winding the wire 4 according to a helix. With reference to the embodiment shown in FIG. 2-4, the number of winding tools is two and are arranged to form together preferably an angle of 90°. Alternatively, a different number of winding tools 8 can be provided. Winding tools 8 are provided with winding bits 9 adapted to contact the wire 4 for bending it according to successive turns which will form the spring turns. Winding bits 9 are preferably arranged perpendicularly to the helix development axis A and are provided with grooves (not shown in figures) at their ends, inside them the wire 4 can longitudinally slide.

Winding tools 8 can be moved towards or far from the helix development axis A. Predefined diameter D of spring which is formed in the device 1 depends on the positions of the winding tools 8 with respect to the helix development axis A. Further, winding bits 9 are rotatable around the winding axis W perpendicularly to the helix development axis A. The object of such rotation is to make flat and to close the end turns of the spring. Moreover, the angular rotation of the winding bits 9 subjects the wire 4 sliding through grooves, to an orientation such to give it a predetermined preload value (also known as initial stress). The terms "preload"/"initial stress" must be understood as the tendency of the wire forming the spring, of keeping the turns adjacent to each other. Therefore, to a high preload corresponds a high tendency of the turns to remain adjacent to each other.

Device 1 comprises at least one pitch tool shaped to act on the wire 4 so that the cylindrical helix which is followed by the wire itself, due to the winding system 7, has a predefined pitch p, selected in the machining setting step. The predefined pitch p depends on the configuration which is given to the pitch tool or tools. Pitch p, and consequently the pitch tool configuration, can be selected to be constant (in this case a constant pitch spring is obtained), or to be variable along the helix development axis A (in such case, a variable pitch spring is obtained).

Device 1 can be provided with one or more pitch tools of different types.

According to a possible embodiment, device 1 comprises a first pitch tool 11 provided with an end 12 arranged perpendicularly to the helix development axis A. End 12 is shaped in order to be inserted between two following turns, by engaging them, in order to give to the wire 4 the predefined pitch as subsequent turns are formed. First pitch tool 11 is movable along a first pitch axis P1 normal to the helix development axis A. Movements of the first pitch tool 11 and of its end 12 along the first pitch axis P1 cause a change of the predefined pitch of the spring forming in the device. First pitch tool 11 is sometimes conventionally called vertical pitch tool.

Alternatively or in addition to the first pitch tool 11, device 1 can comprise a second pitch tool 13 having an end 14 placed normal to the helix development axis A. End 14 of second pitch tool is suitable for acting on wire 4 in order to deform the forming plane of the turn under the wire winding step for giving it the predefined pitch p. Second pitch tool 13 is movable along an axis different from the first pitch tool 11, particularly it is movable along a second pitch axis P2 oriented parallel to the helix development axis A. Spring pitch is correlated to the position taken by the second pitch tool 13 along the second pitch axis P2. Second pitch axis 13 is sometimes conventionally called horizontal pitch tool.

Alternatively or in addition, the spring predefined pitch p can be set by the winding bits 9 of the winding tools 8, by suitably rotating them around the winding axis W. The winding bits 9 of winding tools 8 can be used, for example, as pitch tools in case of compression springs having a limited pitch value.

Advantageously, the device 1 further comprises a cutting tool 16 for separating the spring formed in device 1 from wire 4 when the latter is fed into the winding system 7, once the spring itself has been completed.

Further, device 1 comprises a system 15 for detecting the actual pitch of the spring forming in the device according to the cited modes. In other words, detecting system 15 is capable of detecting the actual pitch between following turns of the spring, as they are formed.

The actual pitch detecting system 15 preferably comprises non-contact sensors, particularly an optical sensor. For example, actual pitch detecting system 15 can comprise laser measuring systems, one or more cameras, or combined systems, such as for example laser profile meters.

Preferably, actual pitch detecting system 15 is placed in a fixed position of the device 1 and, still more preferably, frames a fixed area of the device 1, in other words, it detects, during the spring formation, its pitch in the same area of the device (corresponding to following portions of the forming spring). This theoretically enables to continuously monitor the actual pitch of the spring, as the latter is formed, since the first pair of turns.

Figure 5:
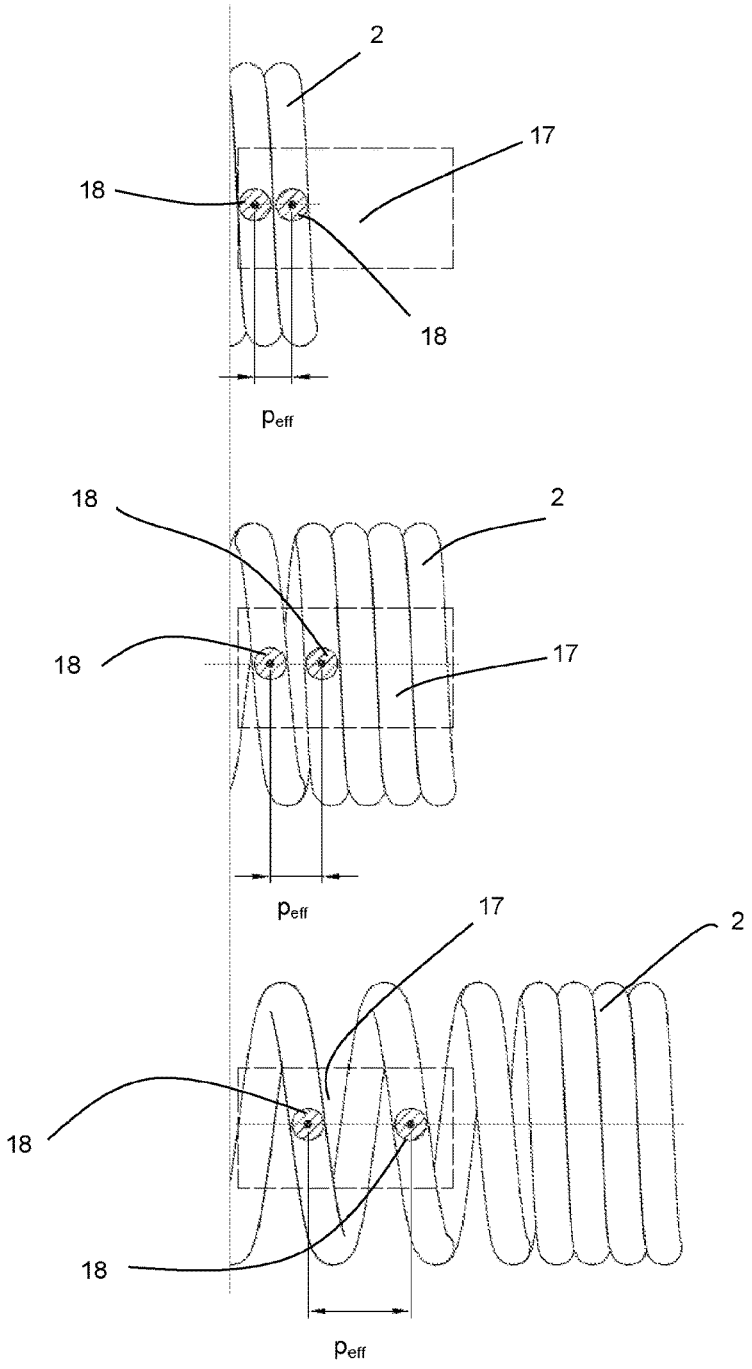
FIG. 5 shows the formation of a spring by a spring forming method according to the invention in successive instants.

The mode of detecting the actual pitch of the spring forming in the device, is shown in FIG. 5, which illustrates the spring 2 in three following instants during its formation. The actual pitch $p_{eff}$ is detected in the detecting area 17 (highlighted by a dashed rectangle), stationary with respect to the device 1. The actual pitch $p_{eff}$ can be for example determined as the geometrical centroid of the distance of the spring hatched areas in the figure, belonging to two following turns, which are detected by the detecting system 15.

Preferably, detecting system 15 is provided and configured for detecting the actual pitch of spring 1 from the beginning of its formation in the device, in other words from the first formed pair of turns. So, detecting system 15 frames an area proximate to the winding bits 9 of the winding tools, from which the helix bent wire exits. Alternatively, for example, if the overall size does not enable the above described configuration, it is possible to position and configure the actual pitch detecting system 15 so that this is capable of detecting the spring actual pitch when a certain number of following turns has been already formed. In other words, according to this configuration, the detecting system frames and detects the spring pitch in a detecting area at a certain distance from the winding bits 9 of the winding tools 8. In this case, it is necessary to acquire the actual length obtained by the forming spring until it enters the detecting area of the detecting system 15. Such length is equal to the distance between the detecting area of the detecting system 15 and the wire starting winding point, at the winding system 7.

The actual pitch detection enables, as it will be explained, to modify the configuration of one of the pitch tools during the spring formation in case the actual length of the spring varies from a reference length corresponding to a certain amount of fed wire I.

It is to be observed that, in addition to the actual pitch detecting system 15, device 1 can comprise further vision systems. Referring to the embodiment shown in FIGS. 2-4, device 1 can comprise a system for detecting that the forming spring has reached the final overall length. For example, such system can comprise a camera 19 and a illuminator 20 located at a distance from the winding system 7, corresponding to the final length set for the spring.

Device 1 comprises a control unit controlling the operation of the device itself for producing springs according to predefined specifications.

Control unit is configured for determining the actual length $L_{eff}$ of the spring forming in the device during following instants. Such actual length is particularly estimated from the actual pitch $p_{eff}$ detected by the actual pitch detecting system 15 and from the wire I amount fed at the instant wherein the actual pitch is detected, obtainable by the fed wire amount detecting means. As the spring is forming, therefore, the fed wire amount and the actual pitches of the spring portion arranged in the detecting area 17 are acquired. The actual spring length $L_{eff}$ at each detecting instant can be estimated by integrating the detected actual pitches (present and preceding) into the turn number formed in the device. The turn number n is correlated to the fed wire I amount by the relation $n=I/\pi D$, wherein D is the average diameter of the spring.

Moreover, control unit is configured for determining a reference length L as a function of the actual amount of fed wire I. The reference length L represents the predefined ideal length which a spring should have as it is forming in the device, as a function of the fed wire I amount. The relation between the reference length L and the fed wire I amount can be for example obtained by measuring the actual lengths corresponding to the wire amounts, which are also known or measurable, of a sample spring having dimensional characteristics corresponding to the design data of the spring which will be formed in the device, or falling into predetermined allowances.

Control unit, as the spring forms, in other words as the wire is fed, can therefore compare the actual length $L_{en}$ of the forming spring with the reference length L. Control unit is particularly configured for determining an error between the actual length $L_{eff}$ and the reference length L corresponding to a certain fed wire I amount. The effective length is determined by said modes, from the detections of the actual pitch $p_{eff}$ and from the fed wire I amount.

Further, control unit is configured to vary, during the formation of the spring itself of which the detecting system 15 has detected the actual pitch in already formed portions thereof, the configuration of one of the pitch tools in order to reduce or cancel such error in spring portions which are still going to be formed. The predefined pitch (dependent on the configuration, particularly on the position of the pitch tool) is therefore changed in order to compensate the spring length error.

Therefore, device 1, by the control unit, executes during the spring formation, a feedback control of the error between the estimated spring actual length $L_{eff}$ during its formation and the reference length L, and corrects the configuration, for example the position, of one of the pitch tools so that the detected error between the actual length $L_{eff}$ and predefined length L is cancelled or reduced in spring portions which will be formed in the following at the spring portions wherein the actual pitch has been detected.

Control unit can act by generating a suitable command signal, for example an electric one, to the first 11 or second pitch tools 12, when they are provided, in order to change the position respectively along the first and second pitch axes P1, P2. Alternatively, control unit can act on the winding bits 9 of winding tools 8, by modifying the angular position around the winding axes W. According to a possible embodiment, control unit modifies the configuration of the pitch tool itself which has been selected for setting the predefined pitch to the wire. For example, it is possible to set the predefined pitch by the first pitch tool 11, and modify, based on the determined pitch error, the position of the same for correcting the forming spring pitch.

Alternatively, the correlation of the error in the pitch can be performed by modifying the configuration of a pitch tool different from the originally set one for giving the predefined pitch to the wire. For example, the predefined pitch can be given by the first pitch tool 11, and the corrections are executed by acting on the second pitch tool 13 or on the winding bits 9 of the winding tools.

Selecting the pitch tool which performs the length error correction can be executed as a function of the amount of the required correction. For example, the horizontal pitch tool is suitable for major corrections, while the winding bits are suitable for small entity and high accuracy corrections. A further criterion can be of avoiding collisions among the different tools working the wire.

The actual pitch detection and error feedback control between the actual length and reference length are performed, theoretically, in a continuous way. In case it is used a digital instrumentation, instead they will be performed in a discrete way. Obviously, the higher the sampling frequency used for acquiring the actual pitch is, the more accurate the actual length calculation will be.

According to a possible embodiment, control unit is configured to perform a P, PD, PI or PID type control of the error between actual length and reference length. Alternatively, more complex control modes can be used, such as for example fuzzy logic controllers.

The command signal generated by the control unit by said modes can be further corrected based on further parameters.

According to a possible embodiment, command signal, and consequently the variation of the pitch tool configuration, are corrected based on the length of the already formed spring portion, or, in other words, based on the residual lengths of the spring still to be formed with reference to the predefined reference length. Indeed, not corrected residual length errors of the spring would cause errors in the actual final length of the spring. However, significant pitch differences between different spring portions would alter the mechanical characteristics. Preferably, control unit is configured for amplifying the command signal proportionally to the length of the already formed spring and/or to the number of the already formed turns. In other words, if the length error is detected in an initial portion of the formed spring, the error correction will be small, and further error corrections will be possible in the following spring portions. The length error correction is in this way distributed in a substantially homogeneous way on a plurality of turn pairs, in order to obtain a spring having a sufficiently uniform mechanical characteristic along its entire development.

In case the error is detected when a substantial portion of the spring has been already formed, the correction will be more marked, so that the final length of the spring is equal, except for acceptable allowance limits, to the predefined length.

It is observed that, in case the area for detecting the spring actual pitch by the actual pitch detecting system 15 is in proximity to the winding system 7, the actual length $L_{eff}$ of the spring is estimated since the formation of the first turn pair.

In case the actual pitch detecting area of the spring by the actual pitch detecting system 15 is at a certain distance from winding system 7, the spring actual pitch is detected for the first time when the latter has been already formed for a certain length and therefore some length errors could have been added. In this case, as previously explained, it is necessary to take into consideration the distance of the actual pitch detecting system 15 from an origin, which is also stationary, coinciding, for example, with the area from which the wire wound by the winding system 7 exits.

According to a possible embodiment, control unit is configured so that the variation of the tool pitch configuration due to the detection of an error between the actual length $L_{eff}$ and reference length L is gradually executed. In other words, it is preferable that the system response does not have an excessive rapidity in order to avoid the presence of sudden pitch variations in the forming spring, due to a sudden correction of the pitch tool configuration. So, the pitch tool command signal from control unit can be filtered in a ramp generator, so that also the signal will have a ramp trend, starting from zero and reaching a value set by the control unit. In this way, the variation of the configuration, particularly the position, of the pitch tool is gradually performed.

According to a further aspect of the present invention, a method for forming a helical spring starting from a wire comprises the steps of:

feeding the wire;

winding up the wire according to a helical configuration having a predefined diameter D and predefined pitch p;

detecting the actual pitch of the forming spring;

detecting the fed amount of the wire at the instant of the actual pitch detection;

determining the actual length $L_{eff}$ of the forming spring starting from the actual fed amount of the wire I and from the actual pitch $p_{eff}$ detected for already-formed spring portions;

determining a reference length L as a function of the actual fed wire I amount;

determining an error between the reference length L and the actual length $L_{eff}$;

varying the predefined pitch p as a function of such error between the actual length $L_{eff}$ and the reference length L.

Such method can be particularly actuated by the spring forming device 1 as previously described.

The step of varying the predefined pitch p can comprise a step of supplying a command signal to a pitch tool, for example one of the types described with reference to device 1, for modifying the configuration, for example the position.

Analogously, the step of determining the forming spring actual length can comprise a step of receiving a signal representative of the actual pitch of the forming spring, from a pitch detecting system and a step of receiving a signal representative of the wire amount fed by supplied wire amount detecting means, such as, for example, the type described with reference to device 1.

The step of varying the predefined pitch as a function of the error between actual length and reference length, as said with reference to device 1, can be performed by P, PD, PI or PID type controllers, or by more complex controllers, for example fuzzy logic controllers.

The predefined pitch variation as a function of the error between actual length and reference length can be amplified proportionally to the actual length of the already formed portion and/or the already formed turn number of the spring, according to what has been discussed with reference to device 1.

The predefined pitch variation as a function of the error between actual length and reference length has preferably a ramp trend obtained for example by filtering the command signal in a ramp generator, in order to be gradual.

The above described method can be implemented for example by a computer program directly downloadable in a working storage of a processing system for executing the steps of the method itself.

Such computer program can be for example downloaded in the control unit of the device 1.

Further, it is observed that the method according to the invention, besides being implemented by software, can be implemented by hardware devices (for example central units) or by a combination of hardware and software.

From the above given description, a person skilled in the art can appreciate as the spring forming device and also its method according to the invention enable to produce springs having a high level of working accuracy, particularly in terms of length and pitch.

The device and method according to the invention are equally applicable to helical springs of different configurations, therefore not only to constant pitch cylindrical springs, but also to more complex shape springs, such as for example conical or biconical springs, having a constant or variable pitch.

Further, since the length error control is performed during the spring machining, it can be corrected during the formation of the same. Therefore, the risk of wasting material and discarding springs with poor size accuracies is reduced.

Lastly, a person skilled in the art can appreciate as the device and method according to the invention enable to distribute the error correction along all or a substantial part of the length of a spring, which will be therefore uniform with reference to its size and mechanical characteristics.

A person skilled in the art, in order to satisfy contingent specific needs, can introduce several additions, modifications, or substitutions of elements with other operatively equivalent ones to the described embodiments without falling out from the scope of the attached claims.

The invention claimed is:

1. Spring forming device comprising:

a system for feeding a wire for forming a helical spring;

a winding system suitable for winding said wire according to a helical configuration having a predefined diameter (D) extending along a helix development axis (A);

one or more pitch tools, each adapted to act on wire such that it takes on said cylindrical helix configuration with a predetermined pitch (p);

a system for detecting an actual pitch ($p_{eff}$) of the spring forming in the device starting from said wire and a control unit comprising means for detecting an amount (I) of the fed wire;

said control unit is configured to:

determine an actual length ($L_{eff}$) of the spring forming in the device, based on the actual fed wire amount (I) and pitch ($p_{eff}$) detected for spring portions already formed in the device;

determine a reference length (L) as a function of said actual amount (I) of fed wire;

determine an error between said reference length (L) and said actual length ($L_{eff}$); and generate a command signal such that, during spring formation, the configuration of one of said one or more pitch tools is varied as a function of said error.

2. Spring forming device according to claim 1, wherein said one or more pitch tools comprise a first pitch tool having an end arranged at right angle with respect to the helix development axis (A), adapted to engage wire between subsequent turns of the helix in order to set the predetermined pitch (p) to it, wherein said first pitch tool is movable along a first pitch axis (P1) perpendicular to helix development axis (A), the predetermined pitch (p) of spring being correlated to the position of first pitch tool along said first pitch axis (P1).

3. Spring forming device according to claim 2, wherein said one or more pitch tools comprise a second pitch tool having a second end arranged at right angle with respect to the helix development axis (A) adapted to engage the wire such as to deform the turn forming plane during winding up, so as to impose to the wire the predetermined pitch (p), wherein said second pitch tool is movable according to a second pitch axis (P2) parallel to the helix development axis (A), the predetermined pitch (p) of the spring being correlated to the position of second pitch tool along said second pitch axis (P2).

4. Spring forming device according to claim 1, wherein said winding system comprises one or more winding tools having winding tips arranged at right angle with respect to the helix development axis (A), said winding tips comprising guiding grooves for winding the wire, wherein said one or more winding tools are movable with respect to the helix development axis (A), the predetermined diameter (D) of the spring being correlated to the position of the one or more winding tools relative to the helix development axis (A), wherein said winding tips are rotatable around winding axes (W) perpendicular to the helix development axis (A), the angular position of said winding tips around winding axes (W) being correlated to a predetermined pre-load of the spring.

5. Spring forming device according to claim 4, wherein said winding tips embody third pitch tools of said one or more pitch tools, the predetermined pitch (p) of the spring being related to the angular position of said winding tips around said winding axes (W).

6. Spring forming device according to claim 1, wherein said system for detecting the actual pitch of the spring forming in the device comprises non-contact sensors.

7. Spring forming device according to claim 1, wherein said system for detecting the actual pitch of the spring forming in the device is located in a fixed position, and is configured to detect the actual pitch of the forming spring in a fixed region of the device.

8. Spring forming device according to claim 1, wherein said control unit embodies a closed loop controller of said error between reference length (L) and actual length ($L_{eff}$).

9. Spring forming device according to claim 1, wherein said control unit is configured such that said command signal is amplified proportionally to actual length ($L_{eff}$) of the spring forming in device and/or the number of turns of the portion of spring already formed in the device.

10. Spring forming device according to claim 1, wherein said control unit is configured such that said command signal follows a ramp pattern, so that said variation of configuration of the one of said one or more pitch tools takes place gradually.

11. Method for forming an helical spring starting from a wire, comprising the steps of:

feeding said wire;

winding up said wire according to a helical configuration having a predetermined diameter (D) and a predetermined pitch (p);

detecting actual pitch ($p_{eff}$) of the forming spring starting from said wire;

detecting the fed amount (I) of wire;

determining an actual length ($L_{eff}$) of the forming spring, based on the detected actual fed amount (I) of wire and actual pitch ($P_{eff}$) for already-formed spring portions;

determining a reference length (L) as a function of said actual fed amount (I) of wire;

determining an error between said reference length (L) and said actual length ($L_{eff}$);

varying the predetermined pitch (p) as a function of said error.

12. Method for forming a helical spring according to claim 11, wherein said step of varying predetermined pitch comprises a step of sending a command signal to a pitch tool acting on the wire in order to modify the pitch tool configuration.

13. Method for forming a helical spring according to claim 11, wherein said step of determining actual length ($L_{eff}$) of the forming spring comprises a step of receiving a signal representing the actual pitch ($p_{eff}$) of the forming spring, originating from an actual pitch detecting system, and a step of receiving a signal representing the fed amount of wire (I) from fed wire amount detecting means.

14. Method for forming a helical spring (2) according to claim 11, wherein said predetermined pitch variation is amplified proportionally to said actual length ($L_{eff}$) of the spring and/or to the number of turns of the already formed portion of spring.

15. Method for forming a helical spring according to claim 11, wherein said predetermined pitch variation as a function of said error follows a ramp pattern.

* * * * *